United States Patent [19]

Leclercq

[11] Patent Number: 4,745,531

[45] Date of Patent: May 17, 1988

[54] LIGHTING DEVICE WITH ALL PARAMETERS ADJUSTABLE SIMULTANEOUSLY, IN PARTICULAR FOR USE AS A STAGE LIGHT

[75] Inventor: Didier Leclercq, Paris, France

[73] Assignee: Cameleon, La Garenne Colombes, France

[21] Appl. No.: 868,077

[22] Filed: May 29, 1986

[30] Foreign Application Priority Data

May 31, 1985 [FR] France ..... 85 08252

[51] Int. Cl.[4] ..... F21V 13/12

[52] U.S. Cl. ..... 362/281; 362/268; 362/293

[58] Field of Search ..... 362/16, 17, 18, 293, 362/268, 281, 303, 311; 350/316, 317

[56] References Cited

U.S. PATENT DOCUMENTS

| | | | |
|---|---|---|---|
| 2,650,292 | 8/1953 | Strong | 362/268 |
| 2,950,382 | 8/1960 | Hatch | 362/281 |
| 3,116,022 | 12/1963 | Davis | 362/293 X |
| 3,255,666 | 6/1966 | Davis | 350/315 |
| 4,101,957 | 7/1978 | Chang | 362/268 |
| 4,232,359 | 11/1980 | Leon et al. | 362/281 X |
| 4,298,920 | 11/1981 | Gluck et al. | 362/281 |
| 4,338,654 | 7/1982 | Logothetis | 362/268 |
| 4,462,067 | 7/1984 | Altman | 362/268 |
| 4,519,020 | 5/1985 | Little | 362/268 |
| 4,600,976 | 7/1986 | Callahan | 362/293 X |
| 4,602,321 | 7/1986 | Bornhorst | 362/268 |

FOREIGN PATENT DOCUMENTS

| | | | |
|---|---|---|---|
| 1804980 | 5/1970 | Fed. Rep. of Germany . | |
| 2105389 | 12/1971 | Fed. Rep. of Germany | 362/268 |
| 2550500 | 5/1977 | Fed. Rep. of Germany . | |
| 1362294 | 4/1964 | France | 362/268 |
| 2431658 | 2/1980 | France . | |
| 2546271 | 11/1984 | France . | |
| 1281837 | 7/1972 | United Kingdom . | |

*Primary Examiner*—Stephen F. Husar

*Attorney, Agent, or Firm*—Charles E. Brown; Charles A. Brown

[57] ABSTRACT

A lighting device comprises a light source adapted to produce a light beam. A reflective mirror is disposed behind the light source. The device also comprises a plurality of optical lenses and a plurality of colored filters. The light source comprises at least one filament and has at least one dimension greater than six millimeters in the direction in which the filament is disposed. The colored filters are movable and adapted to be inserted totally or partly into the path of the light beam. They are disposed on the opposite side of the plurality of optical lenses to the light source. An adjustable iris diaphragm is inserted between certain lenses of the plurality of lenses, on the path of the light beam.

17 Claims, 2 Drawing Sheets

LIGHTING DEVICE WITH ALL PARAMETERS ADJUSTABLE SIMULTANEOUSLY, IN PARTICULAR FOR USE AS A STAGE LIGHT

BACKGROUND OF THE INVENTION

1. Field of the invention

The present invention concerns a lighting device adapted to produce a spot of homogeneously colored light with the intensity and color adjustable at the same time.

One particularly advantageous application of this type of device is to stage lighting although, generally speaking, any situation entailing recourse to colored lighting may constitute an application of the present invention.

For example, the invention may be applied to film and photographic lights.

2. Description of the prior art

When it is required to light a particular area and at the same time to color it in a particular way, it is known practise to illuminate the area using a plurality of combined light sources.

More specifically, obtaining a specific coloration in a localized spot of light in conjunction with a particular luminous intensity is usually achieved by arranging for a plurality of uniformly colored light beams to converge on the spot, each beam being in one fundamental color, so that by appropriately adjusting these fundamental colors the required color may be obtained.

The relative adjustment of the fundamental colors is usually obtained by individually adjusting the luminous intensity of each source.

This relative adjustment of the intensity of the sources is combined with an overall adjustment of luminous intensity in order to obtain the required intensity of illumination within the spot, in addition to the required color.

The light sources, which are usually spotlights, are spaced from each other and adjusted individually.

This has numerous disadvantages:

There must be many operators sufficiently skilled to aim the various sources simultaneously towards the same subject to be lit and at the same time to adjust the luminous intensity of each spotlight according to the color required and the overall luminous intensity required.

As an alternative to this, the spotlights might be remote controlled, using electric motors, for example, although remote control systems enabling both the orientation and the luminous intensity to be adjusted at the same time are complex and costly.

It is also a frequent requirement to obtain a number of spots of light at different places simultaneously.

Also, the subjects to be lit are often moving. It is then necessary to track them by simultaneous and appropriate orientation of the spotlights. As the spotlights are not disposed at the same location, for reasons of size and mobility, it is a relatively complex task to track a moving subject, especially when using simultaneous remote control.

In practise, the angles of incidence relative to the subject of the spotlights whose beams are combined in order to obtain the required coloration of the resulting spot are sufficiently different to create a non-homogenous spot.

Each spotlight creates a spot, which is generally substantially oval because of the obliqueness of the beam relative to the plane in which the subject is moving, and the spots cannot be superimposed exactly, for the reasons given above.

The most advantageous solution to this problem consists in carrying out the required mixing of colors in a single spotlight or, more generally, on the path of propagation of a light beam.

A solution of this kind has already been envisaged and is described in French patent No. 2,546,271 published 11/1984.

This solution provides a spotlight comprising a light source, means for conferring on the light source a definite propagation direction, so defining a beam, and means for adjusting the width, intensity and color of the beam.

The beam is colored by inserting into its path a plurality of colored filters comprising films of colored transparent material, the term of art for which is "gelatins", each colored filter being placed over a greater or lesser part of the transverse cross-section of the beam.

Thus according to the proportion of colored surfaces inserted into the light beam by each filter relative to the overall surface area of the cross-section of the beam at the level of the filter, there is obtained a density of coloration in the color of the appropriate filter depending on the adjustment applied.

In practise it has been found necessary to implement each filter in two parts movable in a plane normal to the light beam, the two parts of each filter joining completely in one extreme position and being able to occupy all intermediate positions between this and another extreme position in which they are moved apart so as to no longer intersect the light beam.

Although constituting a significant advance relative to the prior art, the resulting colored light spots lack homogeneity.

The explanation for this is as follows: when a filter partly colors the light beam, being inserted into a defined part of the surface area of the transverse cross-section of the beam, it colors precisely one part of this surface area.

This means that one part of this cross-section is totally colored by the filter, whereas the remaining part of the surface is not colored at all by this filter.

For example, if 40% only of the beam cross-section is colored red, 40% of the beam cross-section will be totally red and the remainder totally white.

This will be noticeable in the spot of light illuminating the subject, which is not the required result.

What is wanted, in the specific case of the example just mentioned, is a spot colored 40% red over all of its surface area, homogeneously.

The object of the present invention is to make it possible to color homogeneously a spot of light from a lighting device colored to the required shade, this shade being adjustable at will.

SUMMARY OF THE INVENTION

The present invention consists in a lighting device comprising a light source adapted to produce a light beam, a reflective mirror disposed behind said light source, a plurality of optical lenses and a plurality of colored filters, in which device:

said light source comprises at least one filament and has at least one dimension greater than six millimeters in the direction in which said at least one filament is disposed, said colored filters are movable and adapted to be inserted totally or partly into the path of said light beam, said colored filters are disposed on the opposite side of said plurality of optical lenses to said light source, and an adjustable iris diaphragm is inserted between lenses of said plurality of lenses on the path of said light beam.

The lens nearest and immediately adjacent said light source is preferably an aspherical lens of substantially conical shape having a broadly rounded apex and a flat base normal to the direction of propagation of said light beam and facing towards said light source.

Prior art implementations would suggest that disposing the filters on the exit side of the optical lenses would produce a partially, non-homogeneously colored beam.

In practise, the beam and likewise the spot of light produced by a device in accordance with the invention are uniformly colored.

There are advantageously at least two lenses on the exit side of said diaphragm and at least one of said at least two lenses is advantageously movable axially in the direction of propagation of said light beam; said device advantageously comprises at least one adjustable opaque obturator for masking off said light beam to adjust its luminous intensity, said obturator advantageously comprising two opaque plates movable in a plane perpendicular to the path of said light beam and adapted to be totally or partly inserted into said path.

Such arrangements make it possible to adjust the focus, the width of the light beam and the luminous intensity.

Each of said colored filters advantageously comprises a pair of films of colored transparent material and a respective metal frame on which each of said films is stretched, disposed in a plane perpendicular to the path of said light beam, said frames being movable in their respective planes so as to move towards or away from one another in each pair in order to insert said films totally or partly into the path of said light beam.

A device in accordance with the invention advantageously comprises masking means, three colored filters and a non-colored filter adapted to diffuse said light beam to a greater or lesser degree.

In this way it is possible to adjust the device in accordance with the invention so as to obtain a uniform light beam adjustable in width, intensity, color and definition, that is to say in terms of all the parameters that can be adjusted.

A device of this kind as utilized in a spotlight, for example, by virtue of the range of possibilities that it offers can significantly reduce the number of spotlights that have to be used and improve the quality of the spot of light without any other disadvantage.

However, the number of adjustments available entails some complexity of manipulation, a problem that can be resolved advantageously by the use of programmable control means.

The advantages and characteristics of the invention will emerge from the following detailed description given by way of example and with reference to the appended drawings.

DESCRIPTION OF THE PREFERRED EMBODIMENTS

Figure 1:
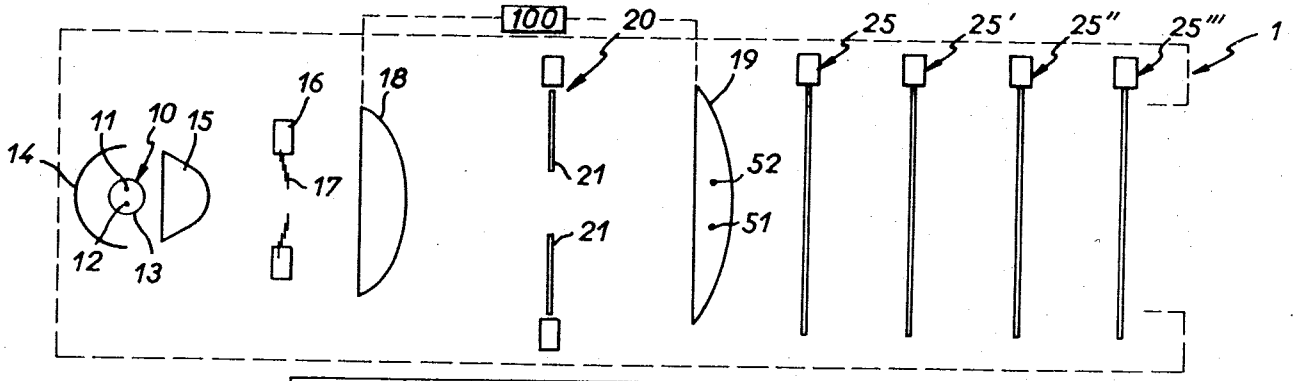
FIG. 1 is a schematic representation in longitudinal cross-section of one embodiment of the invention.
Figure 2:
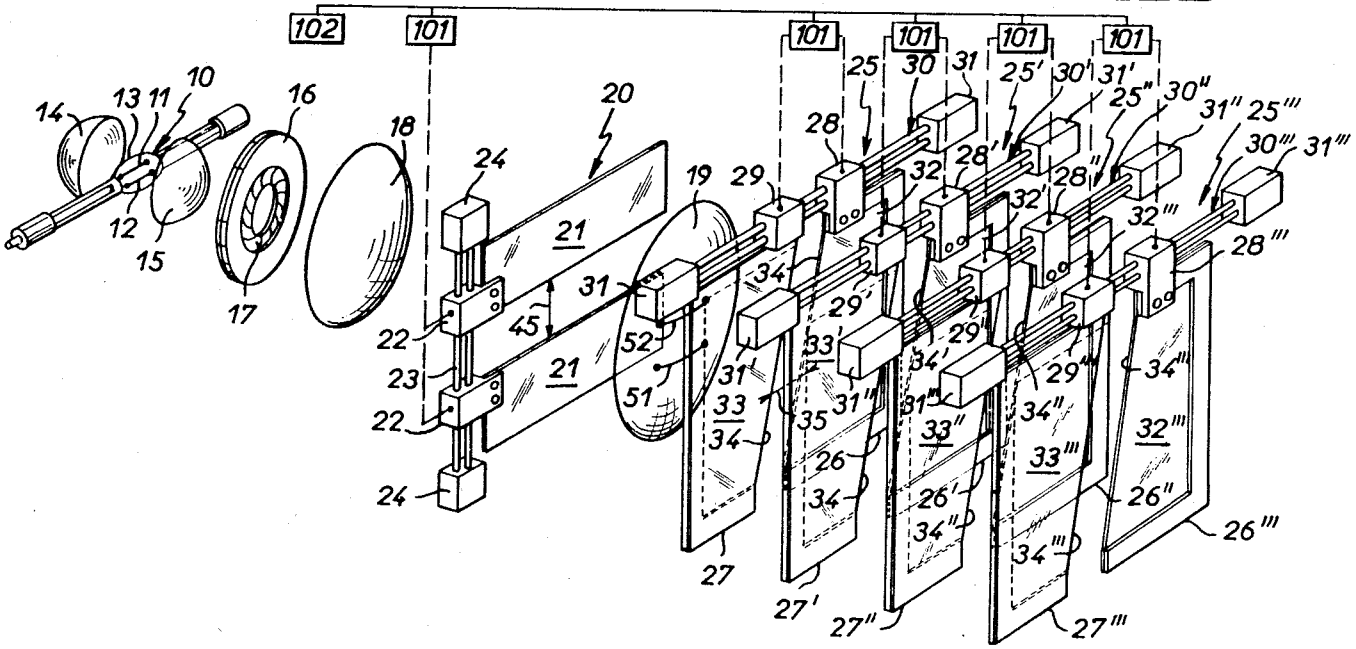
FIG. 2 is a schematic representation in perspective of the embodiment of the invention shown in FIG. 1.

Referring to FIGS. 1 and 2, a spotlight 1 utilizing a process in accordance with a first embodiment of the invention described by way of example comprises a wide light source 10 consisting of a substantially oval glass bulb 13 the axis of which is disposed generally perpendicular to the main axis of the spotlight 1. A typical bulb of this kind has a width in the axial direction in the order of 30 mm and a circular transverse cross-section 25 mm in diameter.

Two filament electrodes 11 and 12 extend parallel to the axis of the bulb 13 inside the latter.

The axial dimension of these two electrodes, which constitute the light source proper, is greater than 6 mm. It is typically 13 mm.

In practise this axial dimension determines the width of the light source. As this is not in this instance negligible relative to the dimensions of the various optical components utilized in the invention and described hereinafter, the light source is characterised as "wide".

The bulb advantageously contains a halogen gas.

Relative to the whole of the spotlight 1, the source 10 is disposed in the proximity of one of the closed ends thereof, referred to here as the upstream end.

The open opposite end from which the light beam exits is referred to here as the downstream end.

On the axis of the spotlight 1, immediately upstream of the source 10, there is disposed a substantially hemispherical reflector 14.

The pole of this hemisphere is disposed on the axis of the projector, facing towards the upstream end. Thus the reflector 14 reflects light from the source 10 in a generally downstream direction.

Downstream of the source 10, coaxial with the spotlight, is an aspherical lens 15. A lens of this kind has a substantially frustoconical shape with the base normal to the axis of the spotlight 1 and the broadly rounded apex facing towards the downstream end of the spotlight.

Further downstream, coaxially with the axis of the spot light 1, there is disposed an annular iris diaphragm 16 with an annular opening 17 the diameter of which is adjusted by appropriate control means (not shown).

A diaphragm of this kind, similar to those routinely used in cameras, is known per se.

On the downstream side of the diaphragm 16 there is disposed a coaxial first lens 18.

In the embodiment being described a lens such as this is generally convex and asymmetric in the axial direction; it has a substantially plane surface at the upstream end and a curved, substantially part-spherical surface facing towards the downstream end.

A second lens 19 of a similar kind to the first is disposed coaxially at the downstream end of the latter, at a distance adjustable by axial displacement of at least one of the two lenses 18 and 19.

In practise both lenses are axially movable and may be maneuvered by axially moving means 100.

In the embodiment described here by way of example, the second lens 19 has a larger diameter than the first and is also convex and asymmetric in the axial direction, having a substantially plane surface facing upstream.

A mirror image 51, 52 of the electrodes 11, 12 is formed in the lens 19.

Between the lenses 18 and 19 there is disposed an obturator 20, in a plane normal to the axis of the spotlight. This obturator 20 is advantageously disposed axially substantially half-way between the two lenses 18 and 19.

The obturator 20 consists of two rectangular plates 21 which are opaque, being of metal, for example, and rigidly mounted on supports 22 adapted to slide on a slideway 23, formed by two parallel rails, for example.

The slideway 23 is disposed in a direction perpendicular to the axis of the spotlight, slightly offset from the axis.

In practise the axis of the spotlight intersects the median line of the plates 21 parallel to the slideway 23.

Two stop members 24 at the ends of the slideway determine the travel of the supports 22 between two extreme positions, namely:

a first position in which the plates 21 meet edge-to-edge, adjacent to each other in their plane, and a second position in which the plates 21 are at a maximum separation 45 determined by the displacement of the supports 22 permitted by the stop members 24 when they slide on the slideway 23.

Downstream of the lens 19 in planes substantially normal to the axis of the spotlight is a succession of four filters 25, 25', 25'', 25''' that are axially equidistant.

With a view to simplifying this description, only one of these filters will be described, namely the filter 25, it being understood that apart from the color and/or the nature of the surface of a filter element, all these filters are strictly identical.

The elements described that are identical in each filter have the same reference numbers with the appropriate suffix (', '', ''') to identify the filters of which they form part, for which the same suffix is used.

The filter 25 comprises two U-shaped frames 26 and 27 which are asymmetric in that one of the branches of the U is longer than the other, the two frames being identical and disposed head-to-tail in two closely spaced parallel planes so that the two frames may be partially superposed with negligible clearance.

The two frames 26 and 27 are in fact disposed in a substantially edge-to-edge relationship so that, when they are partially superposed, the ends of the branches of the frame 26 partially overlap the ends of the two branches of the frame 27, the frame 26 being further downstream.

The frames 26 and 27 are mounted on respective supports 28 and 29 adapted to slide on a slideway 30. The slideway 30, similar to the slideway 23 of the obturator, comprises two parallel rails, for example.

In the embodiments of the present invention here described the slideway 30 is, within the general plane of the filter 25, normal to the axis of the spotlight and perpendicular to the direction of the slideway 23.

This direction may be defined as the horizontal direction, the slideway 23 being vertical, this naturally being relative to the direction of the axis of the spotlight which is in this case horizontal.

The slideways may be oriented differently in other embodiments, however.

Two stop members 31 are disposed at the ends of the slideway 30 to limit the travel of the supports 28 and 29.

This travel determines the displacement of the frames which may be separated from one another or moved together until the ends of the their branches are slightly superposed, such superposition being limited by the two supports 28 and 29 butting up against one another.

Over the frames 26 and 27 are stretched filter elements consisting of transparent films 32 and 33, respectively, usually called gelatins.

These gelatins are in the shape of a right-angle trapezium so as to cooperate with the unequal size branches of the U formed by each frame and, like these frames, are disposed head-to-tail so that their slant edges 34, the only edges not attached to the frames, are parallel.

When the supports 28 and 29 are moved apart against the stop members 31 the edges 34 are also separated and the axis of the spotlight passes through the middle of the space 35 separating them. The filter is then in the so-called open position. When the supports 28 and 29 are butted up against each other, the gelatins 32 and 33 overlap through partial superposition in a defined narrow strip, effectively in a single plane, through an edge 34 and the projection in a axial direction of the other edge 34 in the same plane.

The superposition is made as narrow as possible and actually provides a safety margin to ensure that when the filter 25 is in this, so-called closed position the axis of the spotlight passes through the gelatins 32 and 33.

The gelatins 32 and 33 are of the same nature and the same color.

In the embodiments described the gelatins of the filters 25, 25' and 25'' have a smooth surface and are of three different colors, preferably complementary colors.

On the other hand, the gelatins 32''' and 33''' of the filter 25''' are not colored and have a granular surface, such gelatins being adapted to diffuse the contour of a light beam passing through them.

Movement along their respective slideways of the support 22 of the obturator and the supports 28 and 29 and their counterparts in the other filters is controled by appropriate control means, advantageously programmable control servomotors. Motor means 101 is used to slide the filter frames and a remote-controlled motor 102 operates the motor means 101.

Figures 3, 4:
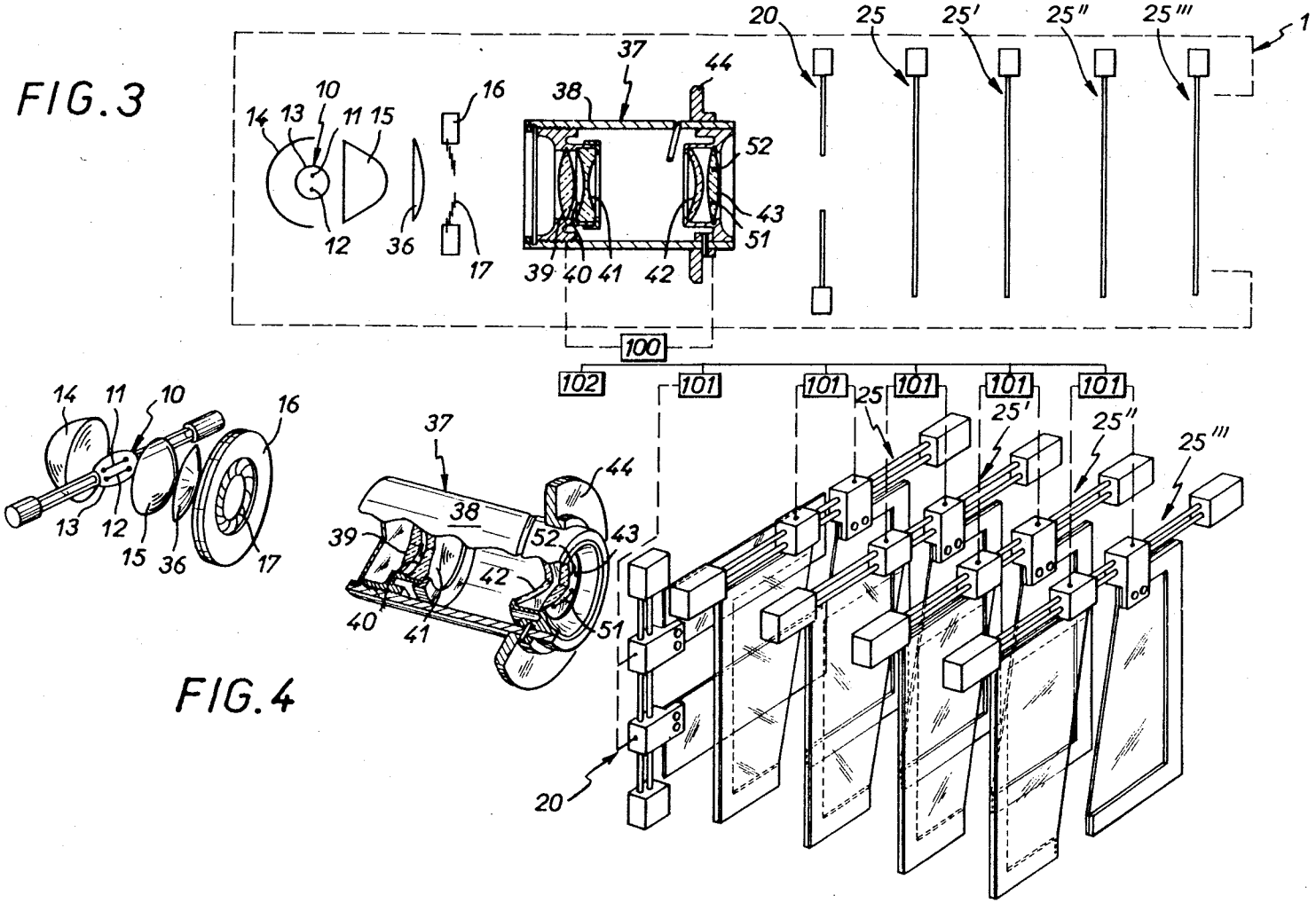
FIG. 3 is a schematic representation in longitudinal cross-section of an alternative embodiment of the invention.
FIG. 4 is a schematic representation in perspective of the alternative embodiment of the invention shown in FIG. 3 with one component shown partially cut-away.

FIGS. 3 and 4 show an alternative embodiment of the invention in which the elements already described in connection with the first embodiment carry the same reference numbers.

From the upstream to the downstream end there are a hemispherical reflector 14, a wide source 10 and an aspherical lens 15.

A second lens 36 of asymmetric convex shape is disposed coaxially on the downstream side of the aspherical lens 15.

Then there is the adjustable aperture iris diaphragm 16.

Downstream of and coaxial with these elements is an optical focussing device 37.

A device of this kind comprises a substantially cylindrical body, a first set of lenses 39, 41 mounted in coaxial sequence and a second set of lenses 42, 43 also mounted in coaxial sequence, this second set being movable axially relative to the first.

An annular support ring 44 projecting radially from the cylindrical body 38 enables the device 37 to be attached to the spotlight.

A mirror image 51, 52 of the electrodes 11, 12 is formed in the lens 43.

Devices of this kind, which are known per se, are usually called zoom lenses and are widely used in photography as well as in stage lighting.

In this embodiment of the invention the obturator 20 is situated on the downstream side of the zoom lens 37, immediately upstream of the cascade of filters 25, 25', 25'' and 25'''.

The obturator 20 and the filters 25, 25', 25'' and 25''' are identical to that used in the first embodiment described.

In the embodiments of the invention currently being described, the reflector 14 reflects part of the light emitted by the wide source 10 in the downstream direction, another part of this light being emitted directly in this direction.

The role of the reflector 14 is to enable all of the light to be directed towards the downstream end of the spotlight.

In practise the spotlight axis is the main direction of propagation of the light, which thus forms a beam.

The light beam passes through the diaphragm 16 which determines, in proportion to its aperture 17, the diameter of the beam leaving the spotlight.

The axially movable lenses 18, 19 in the first embodiment and the zoom lens 37 in the second embodiment serve to focus the image, in this case a simple circle the sharpness of which is defined by the contour.

To achieve the required homogenous mixing of colors, it is preferable to bring about correct focussing to produce a clearly delimited light beam.

The function of the obturator 20 situated either between the lenses 18 and 19 or downstream of the zoom lens 37 is to adjust the luminous intensity.

When the obturator is in the open position the gap 45 between the plates 21 is sufficiently wide to let all the light beam pass through.

The filters 25, 25' and 25'' color the light beam downstream of the obturator to a greater or lesser extent, the gelatins being able to move apart sufficiently when the filter is in the open position not to intersect the path of the beam.

If homogeneous mixing of the colors is to be achieved, any diffuseness such as may be required for certain specific applications must not result from incorrect focussing.

The filter 25''', fitted with granular surface gelatins, serves to produce a beam with diffuse contour from a correctly focussed beam.

The diffuse character of the beam, and consequently of the spot of light that it projects, may be an effect required in certain applications.

In all cases it has been found that once focussing has been achieved the mixing of the colors obtained in the spot of light is homogeneous, despite the disposition of the colored filters on the downstream side of the focussing elements, by virtue of the specific provisions of the invention.

It will be understood that various changes in the details, materials and arrangements of parts which have been herein described and illustrated in order to explain the nature of the invention may be made by those skilled in the art within the principle and scope of the invention as expressed in the appended claims. This applies in particular to the various optical elements, which do not constitute the essence of the invention.

What is claimed:

1. A lighting device comprising a wide light source adapted to produce a light beam, said light source having electrodes with an effective length greater than 6 mm, a reflective mirror disposed behind said light source, and in front of said light source, along the path of the light beam and spaced in succession from said light source toward an outlet end of the lighting device, an adjustable iris diaphragm, at least two optical lenses mounted for displacement along the path of the light beam relative to each other and arranged such that the image of the light source is focused on a forwardmost one of said two optical lenses, and a plurality of colored filters disposed in spaced relationship, each of said plurality of colored filters comprising a pair of films of colored transparent material mounted for movement into and out of the path of the light beam whereby the light beam exiting the lighting device defines a spot of homogeneous color and intensity which is gradually changeable in color by displacement of selective pairs of films of transparent material into and out of the path of the light beam.

2. A lighting device according to claim 1, wherein one of said two optical lenses is an aspherical lens and has a flat base facing said light source and normal to the light beam and a conical surface with a broadly rounded apex facing said adjustable iris diaphragm.

3. A lighting device according to claim 2, wherein said two optical lenses have planar rearward facing surfaces and convex forward facing surfaces.

4. A lighting device according to claim 1, further comprising at one adjustable opaque obturator for masking off the light beam to adjust the intensity thereof.

5. A lighting device according to claim 4, wherein said obturator comprises two opaque plates movable in a plane perpendicular to the path of the light beam between positions into and out of the path of the light beam, and means for supporting and guiding said opaque plates.

6. A lighting device according to claim 1, wherein said pairs of films of colored transparent material have parallel oblique facing edges which are adapted to butt each other, said pairs of films being of identical contour but in reversed upside down relationship.

7. A lighting device according to claim 6, wherein said films of colored transparent material are mounted on frames corresponding in configuration to that of the contours of the respective films.

8. A lighting device according to claim 1, wherein said films of each said pair of films are of the same color.

9. A lighting device according to claim 1, wherein said films of each said pair of films are of different colors.

10. A lighting device according to claim 1, further comprising a diffusing filter comprising a pair of non-colored diffusing transparent material mounted for movement into and out of the path of the light beam for varying the degree of diffusion of the spot, said diffusing filter being disposed adjacent the plurality of colored filters.

11. A lighting device according to claim 10, wherein said pair of non-colored diffusing filter films are mounted in frames, said frames being mounted for movement in a slideway.

12. A lighting device according to claim 7, wherein said frames are mounted for movement in slideways parallel to each other.

13. A lighting device according to claim 1, wherein there are three different color filters.

14. A lighting device according to claim 1, wherein said at least two optical lenses are part of a zoom mechanism.

15. A lighting device according to claim 11, further comprising motor means for moving said frames in said slideway.

16. A lighting device according to claim 12, further comprising motor means for moving said frames in said slideways.

17. A lighting device according to claim 1, wherein said lighting device comprises a stage lighting device.

* * * * *